US006940055B2

(12) United States Patent
Kwasnoski et al.

(10) Patent No.: US 6,940,055 B2
(45) Date of Patent: Sep. 6, 2005

(54) MICROTITER PLATE WITH INTEGRAL HEATER

(75) Inventors: Joseph Kwasnoski, Newtown, PA (US); F. Raymond Salemme, Yardley, PA (US)

(73) Assignee: Johnson & Johnson Pharmaceutical Research & Development, L.L.C., Raritan, NJ (US)

( * ) Notice: Subject to any disclaimer, the term of this patent is extended or adjusted under 35 U.S.C. 154(b) by 79 days.

(21) Appl. No.: 10/172,993

(22) Filed: Jun. 18, 2002

(65) Prior Publication Data

US 2002/0179590 A1 Dec. 5, 2002

Related U.S. Application Data

(62) Division of application No. 10/012,560, filed on Dec. 12, 2001, now Pat. No. 6,423,948.
(60) Provisional application No. 60/254,582, filed on Dec. 12, 2000.

(51) Int. Cl.[7] ..... H05B 6/00; H05B 6/64
(52) U.S. Cl. ..... 219/635; 219/709; 219/433
(58) Field of Search ..... 219/635, 681, 219/428, 385, 386, 438, 433, 441, 702, 701, 704, 709, 679, 690, 695, 696, 697, 746, 748, 750; 422/21, 285, 101, 104; 435/288.4, 809; 436/86; 372/31; 165/58

(56) References Cited

U.S. PATENT DOCUMENTS 4,679,615 A * 7/1987 Livne ..... 165/58
4,948,975 A * 8/1990 Erwin et al. ..... 250/361
5,255,976 A * 10/1993 Connelly ..... 374/31
5,307,144 A * 4/1994 Hiroshi et al. ..... 356/244
5,459,300 A * 10/1995 Kasman ..... 219/433
5,478,748 A * 12/1995 Akins, Jr. et al. ..... 436/86
5,681,492 A 10/1997 Praet ..... 435/809
6,015,534 A 1/2000 Atwood ..... 422/102
6,106,784 A * 8/2000 Lund et al. ..... 422/104

FOREIGN PATENT DOCUMENTS

EP 542422 5/1993
WO WO00/36880 * 6/2000

* cited by examiner

*Primary Examiner*—Quang T. Van
(74) *Attorney, Agent, or Firm*—Wilson, Sonsini, Goodrich & Rosati

(57) ABSTRACT

A microtiter plate system includes an integral heater. In an embodiment, the integral heater includes a heater plate. In another embodiment, the integral heater includes resistive heater wires positioned beneath and/or between the wells of a microtiter plate. In an embodiment, the microtiter plate system includes optically clear well bottoms that permit sensing and measurement of samples through the optically clear well bottoms. In an implementation, an optically clear heater is positioned beneath the optically clear well bottoms. In an alternative implementation, resistive heater wires are positioned between the wells. In an embodiment, the microtiter plate system includes a microtiter plate lid with an integral heater, which can be implemented using a heater plate, resistive wires, and the like. In an embodiment, the microtiter plate system includes an integral non-contact heater, such as a ferrous plate and/or ferrous particles, powder and/or fibers, which generate heat when subjected to an electromagnetic field. An electromagnetic field can be generated by an inductive coil or the like. In an embodiment, the microtiter plate system includes an integral non-contact heater which generates heat when subjected to microwave radiation from a microwave generator. In an embodiment, the microtiter plate system includes an integral thermostat that maintains a substantially constant temperature in the microtiter plate system.

35 Claims, 8 Drawing Sheets

SECTION VIEW A-A'
WITH CONTROLLER

SECTION VIEW A-A'
WITH CONTROLLER

SECTION VIEW OF ALTERNATIVE
HEATER W/CONTROLLER

SECTION VIEW OF MICROTITER PLATE W/
OPTICALLY CLEAR HEATER AND CONTROLLER

SECTION VIEW OF MICROTITER PLATE W/OPTICALLY CLEAR BOTTOM, INTEGRATED HEATER AND CONTROLLER

SECTION VIEW OF MICROTITER PLATE W/OPTICALLY CLEAR BOTTOM, INTEGRATED HEATER, CONTROLLER & HEATED LID

SECTION VIEW A–A' PLATE WITH INTEGRATED FERROUS PLATE FOR NON–CONTACT HEATING

SECTION VIEW A–A' PLATE WITH FERROUS CONDUCTIVE MATERIAL FOR NON–CONTACT HEATING

SECTION VIEW–PLATE IN INDUCTION COIL WITH INFRARED FIBER OPTIC TEMPERATURE SENSOR

END VIEW–PLATE IN INDUCTION COIL WITH INFRARED FIBER OPTIC TEMPERATURE SENSOR

SCHEMATIC-INDUCTIVE HEATING AND NON-CONTACT TEMPERATURE MEASUREMENT & CONTROL SYSTEM

PLATE THERMOSTAT ELECTRICAL SCHEMATIC

THERMOSTAT HYSTERSIS CURVE

MICROTITER PLATE WITH INTEGRAL HEATER

CROSS-REFERENCE TO RELATED APPLICATIONS

This application is a Divisional patent application of U.S. patent application Ser. No. 10/012,560, filed Dec. 12, 2001, now U.S. Pat. No. 6,423,948, which claims the benefit of U.S. Provisional Application No. 60/254,582, filed on Dec. 12, 2000.

BACKGROUND OF THE INVENTION

1. Field of the Invention

The present invention relates to multi-well vessels and, more particularly, to multi-well vessels, such as microtiter plates, with integral heaters.

2. Background Art

Multi-well vessels, such as microtiter plates, are used for storage, processing and testing of biological and chemical samples in the pharmaceutical industry, for example. In many instances, a temperature controlled environment is required to preserve compound integrity or to conduct experiments where temperature is a controlled parameter. It is often desirable to position heating and/or cooling elements close to the samples in order to efficiently control the temperature in the multi-well vessel in a quick an uniform manner.

A typical approach is to provide a cooled or heated metal block, such as aluminum, in contact with a thin-walled plastic microtiter plate. However, the plate-to-block fit is typically inconsistent, which results in inconsistent heating and cooling. Also, the typically large thermal mass of the metal block causes undesirable effects such as temperature non-uniformity between samples. The large thermal mass of the metal block also limits the speed, or response time, at which the samples can be thermally cycled.

What is needed is a method and system for quickly, uniformly, and consistently controlling temperature in multi-well vessels.

BRIEF SUMMARY OF THE INVENTION

The present invention is a multi-well system, which includes a multi-well vessel such as a microtiter plate, and an integral heater formed therein for quickly, uniformly, and consistently controlling temperature. In an implementation, the integral heater includes a heater plate beneath wells of a microtiter plate. In an implementation, the integral heater includes resistive wires positioned beneath and/or between wells of a microtiter plate.

In an embodiment, the multi-well vessel includes optically clear well bottoms that permit sensing and measurement of samples through the optically clear well bottoms. In an implementation, the integral heater includes an optically clear heater positioned beneath the optically clear well bottoms. In an implementation, the integral heater includes resistive wires between the wells.

In an embodiment, the multi-well vessel system includes a lid with an integral heater, which can include a heater plate, resistive wires, and the like.

In an embodiment, the multi-well vessel system includes an integral non-contact heater, such as a ferrous plate and/or ferrous particles, powder and/or fibers, which generate heat when subjected to an electromagnetic field, which can be generated by an inductive coil, for example.

In an embodiment, the multi-well vessel system includes a non-metallic substance, which generates heat when subjected to microwave radiation.

In an embodiment, the multi-well vessel system includes an integral thermostat that maintains a substantially constant temperature in the multi-well vessel system.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

The drawing in which an element first appears is typically indicated by the leftmost digit(s) in the corresponding reference number.

BRIEF DESCRIPTION OF THE FIGURES

The present invention will be described with reference to the accompanying drawings.

DETAILED DESCRIPTION OF THE INVENTION

Table of Contents

I. Microtiter Plate with Integral Heater
- A. System Overview
- B. Integral Heater Plate
- C. Integral Resistive Heater Wires
- D. Optically Clear Well Bottoms
- E. Microtiter Plate Lid with Integral Heater
- F. Integral Non-Contact Heating
  - 1. Electromagnetic Power Source
  - 2. Microwave Power Source
- G. Integral Thermostat II. Conclusions

DETAILED DESCRIPTION OF THE INVENTION

I. Microtiter Plate with Integral Heater

A. System Overview

Figure 1A:
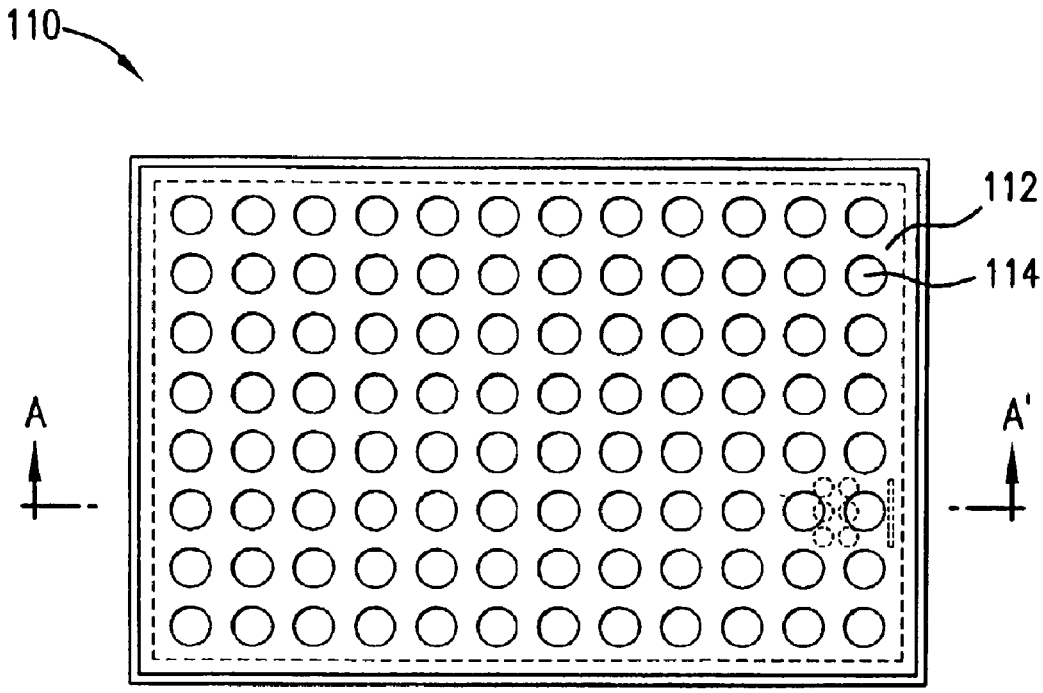
FIG. 1A illustrates an example multi-well vessel, or microtiter plate, system 110 having an integral heater, in accordance with the present invention.
Figure 1B:
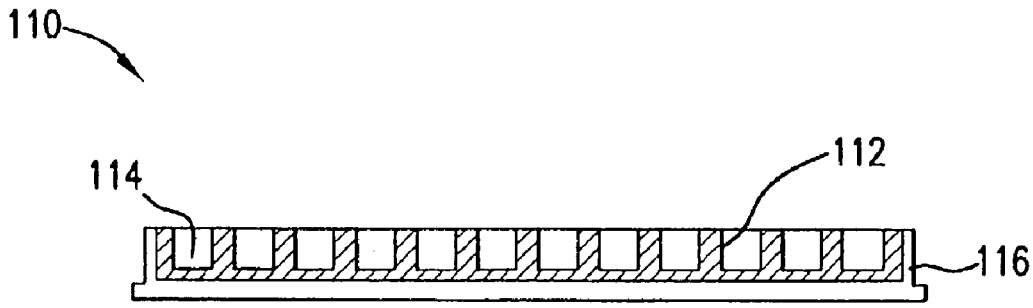
FIG. 1B illustrates a cross-sectional view of the example microtiter plate illustrated in FIG. 1A, taken along the line A–A'.

The present invention is a method and system for quickly, uniformly, and consistently controlling temperature in multi-well vessels such as microtiter plates. FIG. 1A illustrates an example multi-well vessel, or microtiter plate, system 110, in accordance with the present invention. FIG. 1B illustrates a section view of the microtiter plate system 110, taken along the line A–A'.

The microtiter plate system 110 includes a support structure or body 112, and a plurality of wells 114 formed therein for holding test samples. The body 112 is preferably formed from a thermally conductive and chemically inert material. The body 112 includes a heater integrally formed therein. Example implementations of the heater are illustrated in FIGS. 2–12 and described below. The microtiter plate system 110 also includes a power source to induce heating of the body 112. The power source can be an electrical power source, an electromagnetic field generator, a microwave generator, or similar device cable of inducing heat within the body 112. The present invention is not limited to the illustrated examples. Other types and configurations of power sources and heaters are contemplated and are within the scope of the present invention.

The integral heater is preferably in direct contact with the thermally conductive and chemically inert material that forms the body 112. In an embodiment, the body 112 is encapsulated by an insulating material 116, which minimizes environmental effects while providing suitable access to the wells 114 for filling the wells 114, measuring effects within the wells 114, etc.

Example implementations of the microtiter plate system 110 are provided below.

B. Integral Heater Plate

Figure 2:
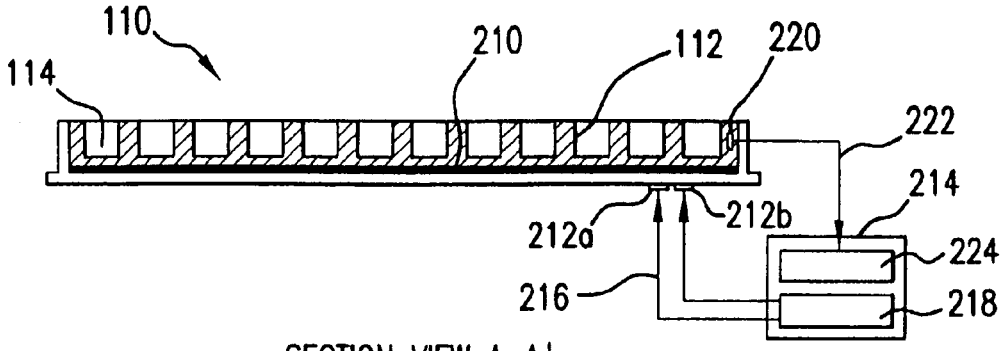
FIG. 2 illustrates an example implementation of the microtiter plate system illustrated in FIGS. 1A and 1B, including an integral heater plate.

In an embodiment, the microtiter body 112 includes a heater plate integrally formed therein. For example, FIG. 2 illustrates an implementation of the microtiter plate system 110, including an integral heater plate 210, which can be a conventional heater plate. In an embodiment, the heater plate 210 includes cut-outs beneath the wells 114, which permit a sensor (see sensor 412 in FIG. 4, for example) to be positioned near the bottom of the wells 114, where samples are typically located. This allows for increased measurement sensitivity and accuracy.

An optional controller 214 includes a heater power controller 218, which provides electrical power to the heater plate 210 through contacts 216 and 212. The contacts 216 can be pogo type contacts, for example.

In an embodiment, the heater plate 210 is controlled by a feedback loop that includes one or more temperature sensors and controller 214. The temperature sensor(s) can include one or more integral temperature sensors 220 and/or one or more an external temperature sensors, such as an infrared temperature sensor 1010 illustrated in FIG. 10. Integral temperature sensor(s) 220 can include an RTD, a thermistor, a thermocouple, or any other suitable temperature sensor, and combinations thereof.

The integral temperature sensor 220, or an external temperature sensor, provides temperature information 222 to the controller 214. For example, temperature information 222 can be provided to a sensor amplifier 224 within the controller 214, which can amplify and/or process the temperature information 222, to control the electrical power output by the heater power controller 218. In an embodiment, the heater power controller 218 is an on/off type of controller. In an alternative embodiment, the heater power controller 218 provides a variable output.

C. Integral Resistive Heater Wires

In an embodiment, the microtiter body 112 includes resistive heater wires integrally formed therein. Heat is generated by the resistive heater wires when a power source is coupled across opposite ends of the wires.

Figure 3:
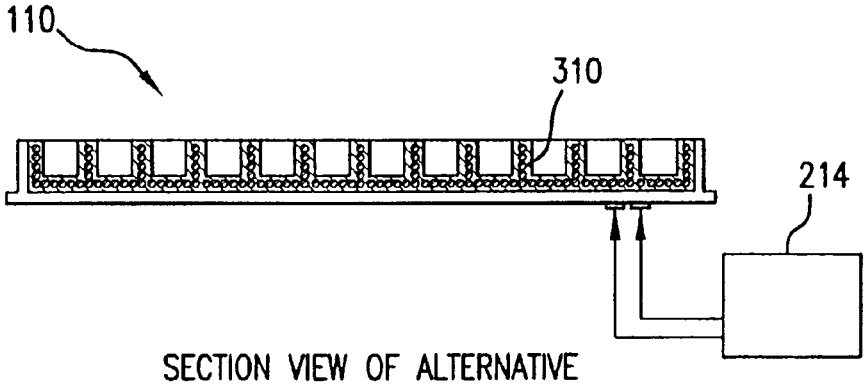
FIG. 3 illustrates an example implementation of the microtiter plate system illustrated in FIGS. 1A and 1B, including integral resistive heater wires.

FIG. 3 illustrates an example implementation of the microtiter plate system 110, including resistive heater wires 310. In the illustrated example, the resistive heater wires 310 are formed beneath and between the wells 114. In an alternative embodiment, the resistive heater wires 310 are formed only beneath the wells 114. In another alternative embodiment, the resistive heater wires 310 are formed only between the wells 114.

Preferably, the resistive heater wires 310 are controlled by the control system 214 and one or more temperature sensors, as described above with reference to FIG. 2.

D. Optically Clear Well Bottoms

In an embodiment, the microtiter body 112 includes optically clear well bottoms and an integral heater that does not obstruct the optically clear well bottoms.

Figure 4:
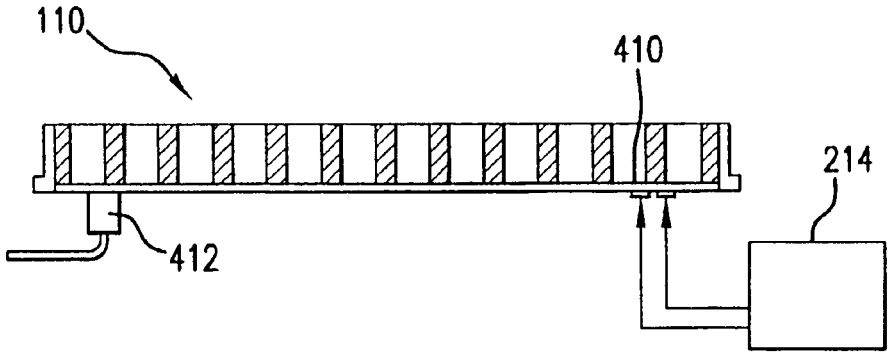
FIG. 4 illustrates an implementation of the microtiter plate system illustrated in FIGS. 1A and 1B, including optically clear well bottoms and an optically clear heater.

For example, FIG. 4 illustrates an implementation of the microtiter plate system 110, including optically clear well bottoms and an optically clear heater 410. The optically clear well bottoms and the optically clear heater 410 permit a sensor 412 to be positioned near the bottom of the wells 114, where samples are typically located. This allows for increased measurement sensitivity and accuracy.

Preferably, the optically clear heater 410 is controlled by the control system 214 and one or more temperature sensors, as described above with reference to FIG. 2.

Figure 5:
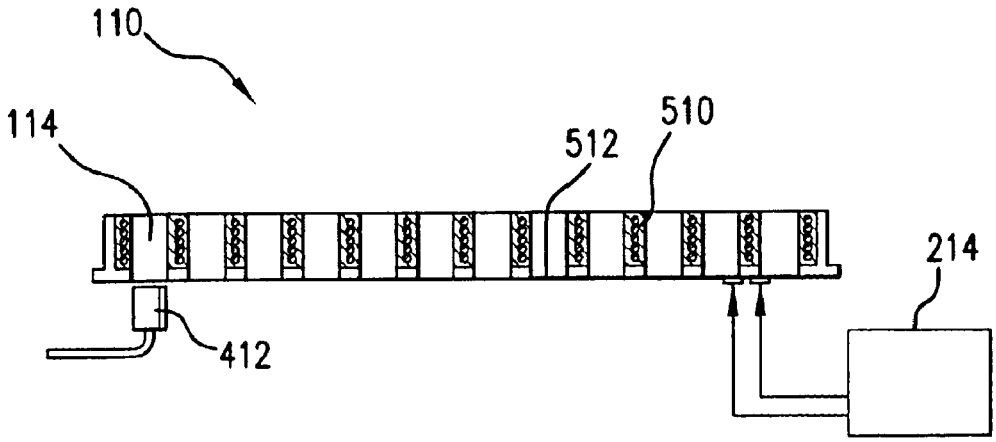
FIG. 5 illustrates an implementation of the microtiter plate system illustrated in FIGS. 1A and 1B, including optically clear well bottoms and resistive heater wires between wells.

FIG. 5 illustrates another example of optically clear well bottoms and an integral heater that does not obstruct the optically clear well bottoms. In FIG. 5, the microtiter plate system 110 includes resistive heater wires 510 between wells 114, which operate as described above with reference to FIG. 3. The resistive heater wires 510 do not obstruct the optically clear well bottoms 512. As a result, the sensor 412 can be positioned near the bottom of the wells 114, where samples are typically located. This allows for increased measurement sensitivity and accuracy.

Preferably, the resistive heater wires 510 are controlled by the control system 214, and one or more temperature sensors, as described above with reference to FIG. 2.

E. Microtiter Plate Lid with Integral Heater

Figure 6:
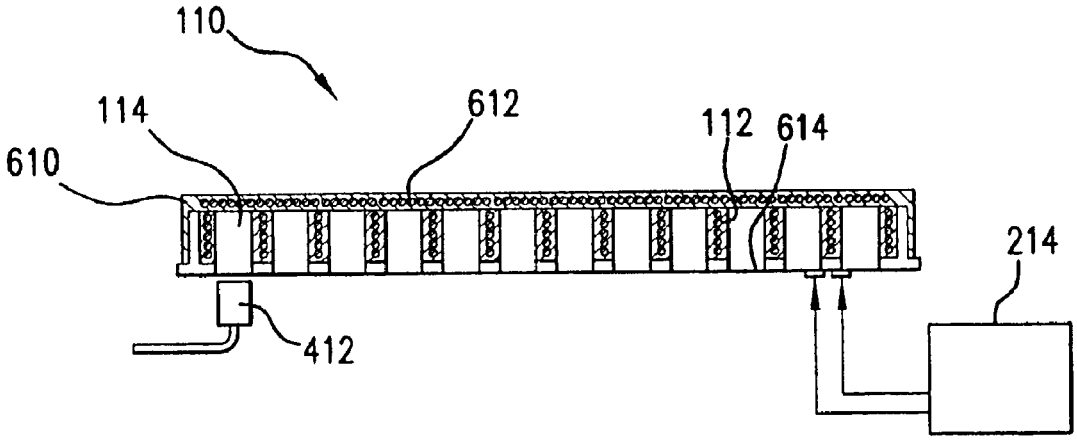
FIG. 6 illustrates an implementation of the microtiter plate system illustrated in FIGS. 1A and 1B, including a lid having an integral heater.

In an embodiment, the microtiter plate system 110 includes a lid with an integral heater. For example, FIG. 6 illustrates an implementation of the microtiter plate system 110, including a lid 610, which includes resistive heater wires 612. The resistive heater wires 612 operate substantially as described above with reference to FIG. 3. The resistive heater wires 612 can receive power through electrical contact with the body 112 or through electrical contact with the controller 214. The lid 610 can include one or more integral temperature sensors or can be controlled by one or more temperature sensors as described above with reference to FIG. 2.

In alternative embodiments, the lid 610 includes a heater plate 210, as illustrated in FIG. 2, or an optically clear heater 410, as illustrated in FIG. 4.

In the example of FIG. 6, the lid 610 is utilized with the body 112 having integral heater wires between the wells 114 and with optically clear well bottoms 614, similar to that illustrated in FIG. 5. Alternatively, the lid 610 can be implemented with any other microtiter body 112, including those illustrated in FIGS. 2–5, 7 and 8.

F. Integral Non-Contact Heating

1. Electromagnetic Power Source

In an embodiment, the microtiter plate system 110 includes an integral, non-contact (i.e., no electrical connections between a microtiter plate and a power source) heater. An integral non-contact heater is useful where, for example, flammability and/or other safety issues arise.

Figure 7:
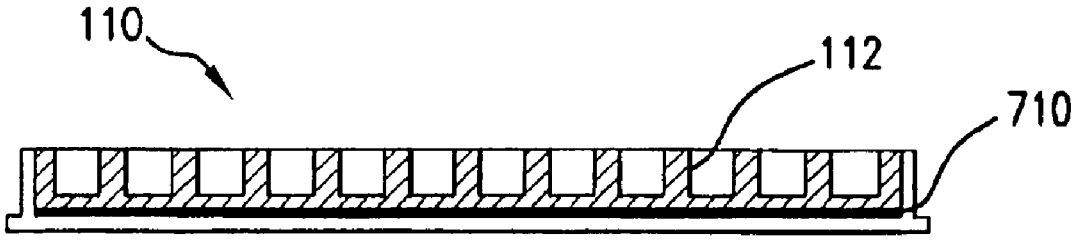
FIG. 7 illustrates a non-contact implementation of the microtiter plate system illustrated in FIGS. 1A and 1B, including a ferrous plate.

FIG. 7 illustrates an example non-contact heater embodiment of the microtiter plate system 110, including a ferrous plate 710 for non-contact heating of the body 112. To induce heat, an electromagnetic field is generated through the ferrous plate 710, inducing eddy currents in the ferrous plate 710, which cause the ferrous plate 710 to generate heat.

Figure 8:
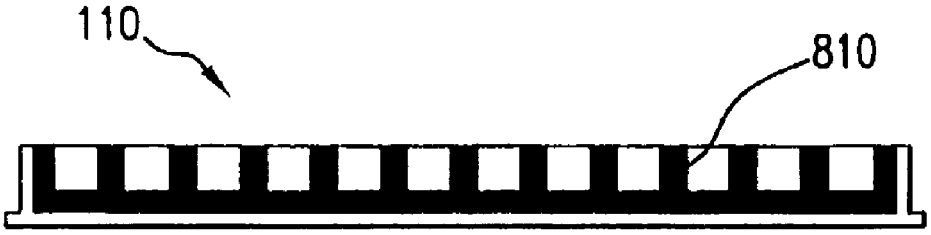
FIG. 8 illustrates a non-contact implementation of the microtiter plate system illustrated in FIGS. 1A and 1B, including ferrous particles, powder and/or fibers.

FIG. 8 illustrates another example non-contact heater embodiment of the microtiter plate system 110, wherein ferrous particles, powder and/or fibers are blended within the body 112. To induce heating, an electromagnetic field is generated through the body 112, inducing eddy currents in the ferrous particles, powder and/or fibers, which then generate heat.

Figure 9:
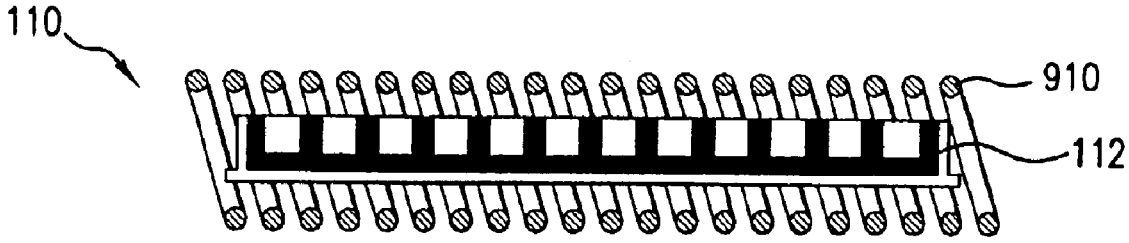
FIG. 9 illustrates an example induction coil that can be used to generate an electromagnetic field for non-contact implementations of the microtiter plate system illustrated in FIGS. 1A and 1B.
Figure 10:
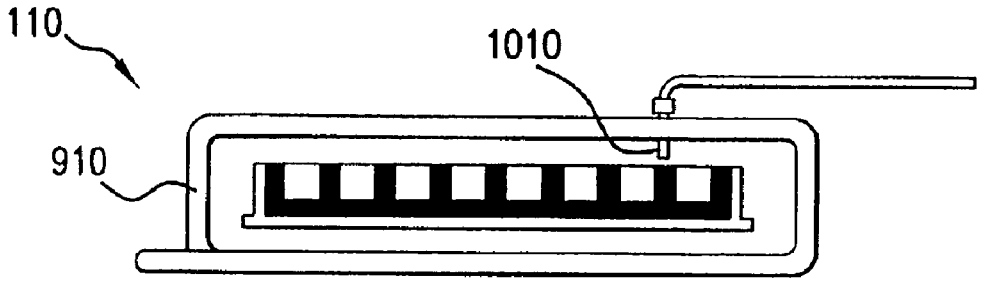
FIG. 10 illustrates an end-view of the induction coil illustrated in FIG. 9.

In an embodiment, the electromagnetic field is generated by an induction coil. For example, FIG. 9 illustrates an induction coil 910 that generates an electromagnetic field when a driving current is provided through the induction coil 910. FIG. 10 illustrates an end-view of the induction coil 910, including an optional infrared sensor 1010. When a non-contact microtiter heating system, as illustrated in FIGS. 7 and 8, for example, is placed within the electromagnetic field generated by the induction coil 910, eddy currents generated in the ferrous material cause the ferrous material to generate heat.

Figure 11:
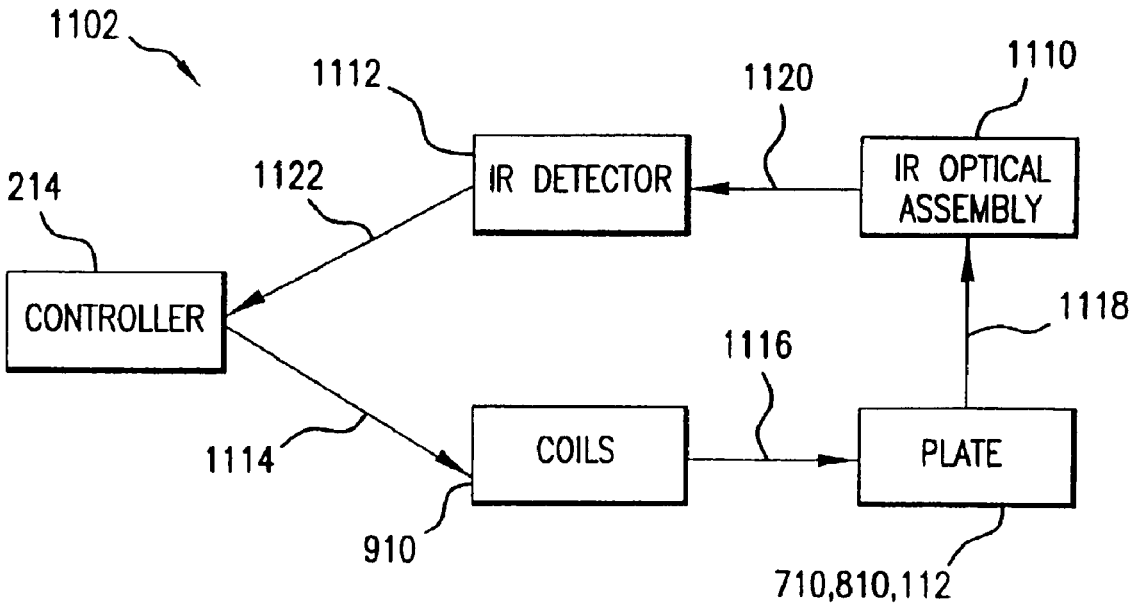
FIG. 11 illustrates a block diagram of a control loop for controlling the temperature of a non-contact heating system.

In an embodiment, the driving current provided to the induction coil 910 is controlled by a feedback loop similar to that described with reference to FIG. 2. For example, FIG. 11 illustrates a block diagram of a control loop 1102 for controlling the temperature of a non-contact heating system. Controller 214 provides a driving current or voltage 1114 to the coils 910. The coils 910 generate an electromagnetic field 1116, which cause the ferrous material (e.g., ferrous plate 710 and/or ferrous particles, powder and/or fibers 810) to generate heat. Infrared emissions 1118 associated with the heat generated by the ferrous material are sensed by an infrared optical assembly 1110, which provides a signal 1120, electrical or optical, to an infrared detector 1112. The infrared detector 1112 provides a control signal 1122 to the controller 214, which adjusts the driving current or voltage 1114 accordingly. Alternatively, one or more temperature sensors and/or thermostats are integrally disposed within the body 112.

In an embodiment, a lid is provided and includes a ferrous plate and/or ferrous particles, powder and/or fibers embedded therein.

In an embodiment, a non-contact heater system includes optically clear well bottoms.

2. Microwave Generator

Figure 15:
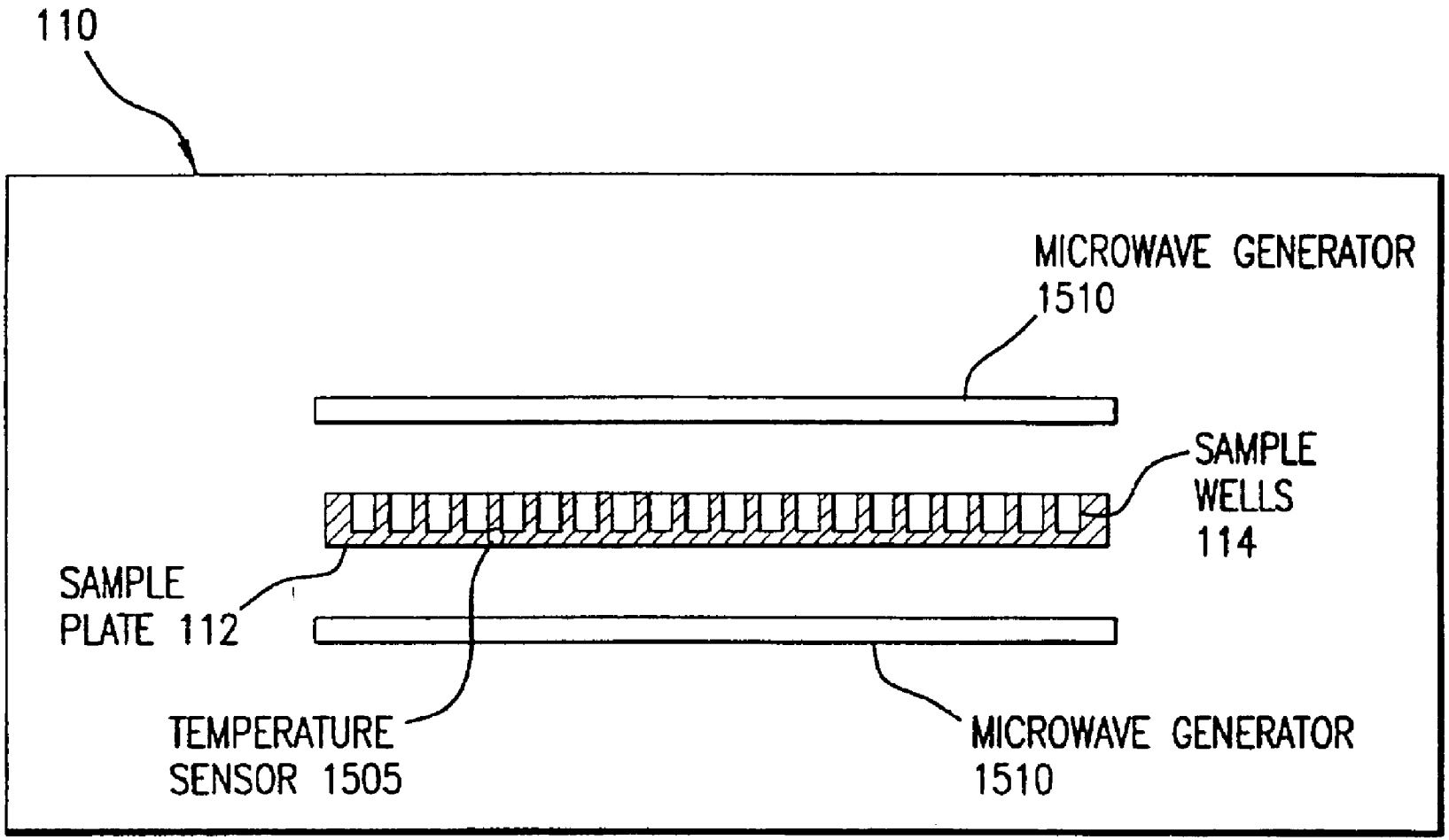
FIG. 15 illustrates a non-contact implementation of the microtiter plate system illustrated in FIGS. 1A & 1B, including a microwave generator.

FIG. 15 illustrates the microtiter plate system 110, including a microwave generator 1510 for providing a substantially uniform microwave field around the body 112. In this embodiment, the body 112 is made of a non-metallic, thermally conductive and chemically inert material. In this way, the microwave generator 112 is able to generate a microwave field to induce heat within the body 112.

In an embodiment, one or more integral temperature sensors 1505 control the temperature of the system 110 by regulating the power supplied to the microwave generator 1510. Power to the microwave generator 1510 is controlled by measuring the temperature indicated by the temperature sensors 1505 located inside the microtiter plate system 110. As the temperature increases, power to the microwave generator is adjusted using a computer controller (not shown).

G. Integral Thermostat

In many applications, a relatively constant temperature must be maintained. For example, many experiments need to be incubated to 37° C., or body temperature. Temperature control of a microtiter plate is typically provided by a cooled or heated metal block, typically aluminum, which is in contact with a thin-walled plastic microtiter plate. Alternatively, temperature control of a microtiter plate is typically provided by a heated or refrigerated environment for the microtiter plate. These approaches are insufficient if additional tests or manipulations are to be performed on the microtiter plate because associated enclosures tend to limit access to the sample wells.

Figure 12:
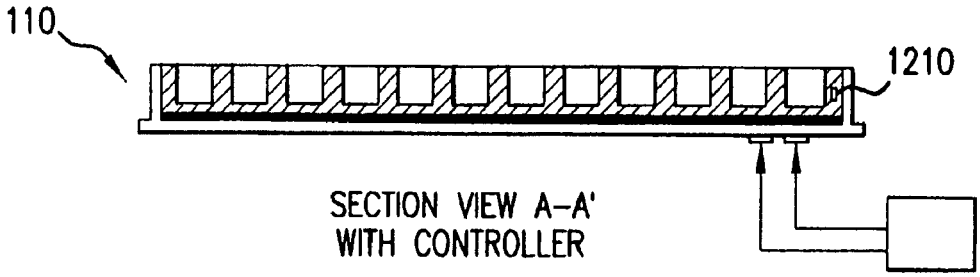
FIG. 12 illustrates an implementation of the microtiter plate system illustrated in FIGS. 1A and 1B, including a temperature self-regulating mechanism.

Thus, in an embodiment of the present invention, the microtiter plate system 110 includes an integral self-regulating heating system. For example, FIG. 12 illustrates the microtiter plate system 110, including an integral thermostat 1210, which controls the temperature of the system 110 by regulating the power supplied to an integral heater. The integral heater can include, but is not limited to, one or more of the integral heaters embodiments illustrated in FIGS. 2–11, for example.

The integral thermostat 1210 can be a bimetal disc thermostat, for example. Alternatively, the functionality of the integral thermostat 1210 can be implemented with an equivalent solid state device or with a micro-controller that includes a temperature sensor and a power switch. Current pob and chip fabrication technology will allow for the latter two embodiments in the range of 0–100° C.

Figure 13:
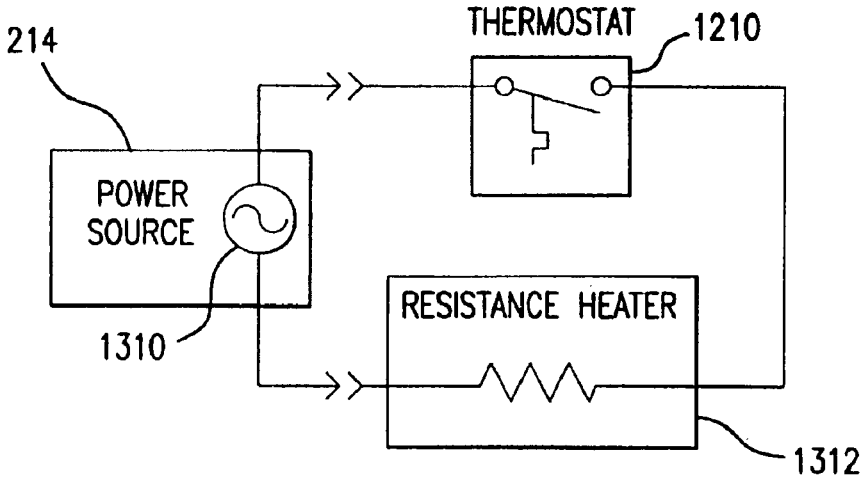
FIG. 13 illustrates an example schematic for the self-regulating mechanism illustrated in FIG. 12.
Figure 14:
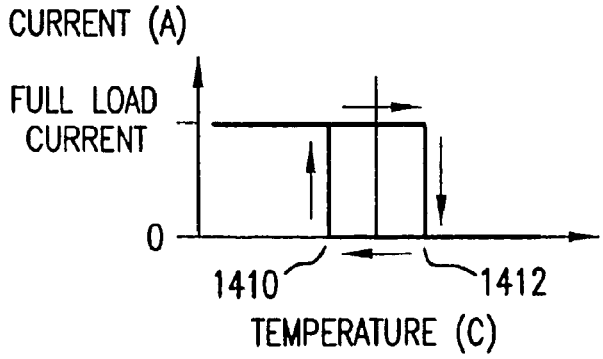
FIG. 14 illustrates an example on/off switching profile for the self-regulating mechanism illustrated in FIG. 12.

FIG. 13 illustrates an example schematic for the self-regulating integral thermostat 1210. FIG. 14 illustrates an example on/off switching profile for the integral thermostat 1210. In FIG. 13, the integral thermostat 1210 is electrically in series with an integral heater 1312, both of which are integral to the microtiter body 112. However, the present invention is not limited to this example schematic diagram. Other implementations are within the scope of the present invention.

In the example of FIG. 13, the controller 214 includes a power source 1310, which is coupled to the integral heater 1312 through the integral thermostat 1210. The power source 1310 is illustrated as an AC power source. Alternatively, the power source 1310 can be a DC power source or a lower voltage DC power source that adheres to new CE and IEC safety standards.

The integral thermostat 1210 switches on or off depending on the temperature of the body 112. For example, as illustrated in FIGS. 13 and 14, the integral thermostat 1210 closes when the body 112 drops to $T_{FALL}$ time 1410, thereby coupling the power source 1310 to the integral heater 1312. When the temperature of the body 112 reaches $T_{RISE}$ time 1412, the integral thermostat 1210 opens to disconnect the power source 1310 from the integral heater 1312.

II. Conclusions

Example embodiments of the methods, systems, and components of the present invention have been described herein. As noted elsewhere, these example embodiments have been described for illustrative purposes only, and are not limiting. Other embodiments are possible and are covered by the invention. Such other embodiments include but are not limited to hardware, software, and software/hardware implementations of the methods, systems, and components of the invention. Such other embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

What is claimed is:

1. A non-contact multi-well heating system, comprising:

a body manufactured from a thermally conductive and chemically inert material, said body including a plurality of wells formed therein; and a non-contact power source that induces heat in said body without electrical contact with said body, wherein said non-contact power source comprises an electromagnetic field generator or a microwave generator.

2. The system of claim 1, wherein said non-contact power source comprises an electromagnetic field generator.

3. The system of claim 2, wherein said body comprises a ferrous plate.

4. The system of claim 3, wherein said electromagnetic field generator comprises an induction coil configured to substantially surround said body.

5. The system of claim 2, wherein said body comprises a ferrous substance disposed within said body.

6. The system of claim 5, wherein said ferrous substance includes ferrous particles blended within said body.

7. The system of claim 5, wherein said ferrous substance includes ferrous powder blended within said body.

8. The system of claim 5, wherein said ferrous substance includes ferrous fibers blended within said body.

9. The system of claim 1, wherein said non-contact power source comprises a microwave generator.

10. The system of claim 1, further comprising at least one temperature sensor disposed within said body.

11. The system of claim 10, further comprising a power source controller coupled between said temperature sensor and said non-contact power source.

12. The system according to claim 11, wherein said power source controller comprises a programmable power source controller.

13. A non-contact method of heating a multi-well sample plate having a ferrous material disposed therein, comprising the steps of:

(1) generating an electromagnetic field around said multi-well sample plate having said ferrous material disposed therein;

(2) sensing a temperature of said multi-well sample plate; and (3) adjusting said electromagnetic field to maintain a desired temperature of said multi-well plate.

14. The method according to claim 13, wherein said multi-well sample plate comprises a ferrous substance disposed within said body.

15. The method according to claim 14, wherein said ferrous substance includes ferrous particles blended within said body.

16. The method according to claim 14, wherein said ferrous substance includes ferrous powder blended within said body.

17. The method according to claim 14 wherein said ferrous substance includes ferrous fibers blended within said body.

18. A non-contact method of heating a multi-well sample plate, having a ferrous material disposed therein, with microwaves, comprising the steps of:

(1) directing microwaves at said multi-well sample plate;

(2) sensing a temperature of said multi-well sample plate; and (3) adjusting an intensity of said microwaves to maintain a desired temperature of said multi-well plate.

19. The method according to claim 18, wherein said multi-well sample plate comprises a ferrous substance disposed within said multi-well sample plate.

20. The method according to claim 19, wherein said ferrous substance included ferrous particles blended within said multi-well sample plate.

21. The method according to claim 19, wherein said ferrous substance includes ferrous powder blended within said multi-well sample plate.

22. The method according to claim 19, wherein said ferrous substance includes ferrous fibers blended within said multi-well sample plate.

23. The method according to claim 18, wherein said multi-well sample plate is manufactured from a thermally conductive and chemically inert material.

24. A non-contact system for heating a multi-well sample plate having a ferrous material disposed therein, comprising:

means for generating an electromagnetic field around said multi-well sample plate having said ferrous material disposed therein;

means for sensing a temperature of said multi-well sample plate; and means for adjusting said electromagnetic field to maintain a desired temperature of said multi-well plate.

25. The system according to claim 24, wherein said multi-well sample plate comprises a ferrous substance disposed within said multi-well sample plate.

26. The system according to claim 25, wherein said ferrous substance includes ferrous powder blended within said multi-well plate.

27. The system according to claim 25, wherein said ferrous substance includes ferrous fibers blended within said multi-well sample plate.

28. The system according to claim 24, wherein said ferrous substance includes ferrous particles blended within said multi-well sample plate.

29. The system according to claim 24, wherein said multi-well sample plate is manufactured from a thermally conductive and chemically inert material.

30. A non-contact method of heating a multi-well sample plate, having a ferrous material disposed therein, with microwaves, comprising:

providing means for directing microwaves at said multi-well sample plate;

providing means for sensing a temperature of said multi-well sample plate;

providing means for adjusting an intensity of said microwaves to maintain a desired temperature of said multi-well plate, and heating said multi-well sample plate.

31. The method according to claim 30, wherein said multi-well sample plate comprises a ferrous substance disposed within said multi-well sample plate.

32. The method according to claim 31, wherein said ferrous substance includes ferrous particles blended within said multi-well sample plate.

33. The method according to 31, wherein said ferrous substance includes ferrous powder blended within said multi-well sample plate.

34. The method according to claim 31, wherein said ferrous substance includes ferrous fibers blended within said multi-well sample plate.

35. The method according to claim 30, wherein said multi-well sample plate is manufactured from a thermally conductive and chemically inert material.

* * * * *